US009997873B2

(12) United States Patent
Ishida et al.

(10) Patent No.: US 9,997,873 B2
(45) Date of Patent: Jun. 12, 2018

(54) CONNECTOR

(71) Applicant: Yazaki Corporation, Minato-ku, Tokyo (JP)

(72) Inventors: Takuya Ishida, Utsunomiya (JP); Tomoyuki Miyakawa, Utsunomiya (JP); Naoki Kobayashi, Utsunomiya (JP); Shinichi Ikemoto, Sagamihara (JP)

(73) Assignee: Yazaki Corporation, Minato-ku, Tokyo (JP)

( * ) Notice: Subject to any disclaimer, the term of this patent is extended or adjusted under 35 U.S.C. 154(b) by 0 days. days.

(21) Appl. No.: 15/724,694

(22) Filed: Oct. 4, 2017

(65) Prior Publication Data

US 2018/0102613 A1 Apr. 12, 2018

(30) Foreign Application Priority Data

Oct. 6, 2016 (JP) ..... 2016-198446

(51) Int. Cl.
*H01R 13/703* (2006.01)

(52) U.S. Cl.
CPC ..... *H01R 13/7032* (2013.01)

(58) Field of Classification Search
CPC ... H01R 13/7032; H01R 13/703; H01R 33/96
USPC ..... 439/188; 200/51.1, 51.09, 51.12
See application file for complete search history.

(56) References Cited

U.S. PATENT DOCUMENTS 4,850,888 A * 7/1989 Denlinger ..... H01R 13/7032 439/188
6,036,515 A * 3/2000 Nakamura ..... H01R 13/7032 439/188
6,039,589 A * 3/2000 LaLange ..... H01R 13/4367 439/188
6,171,124 B1 * 1/2001 Kojima ..... H01R 13/7032 200/51.1
6,186,805 B1 * 2/2001 Krishnaswamy .. H01R 13/7032 200/51.1
6,315,588 B1 * 11/2001 Heberlein ..... H01R 13/7032 200/51.1
6,659,785 B2 12/2003 Nakamura et al.
(Continued)

FOREIGN PATENT DOCUMENTS

JP 2002-305057 A 10/2002
JP 2003-036944 A 2/2003

*Primary Examiner* — Tulsidas C Patel
*Assistant Examiner* — Travis Chambers
(74) *Attorney, Agent, or Firm* — Banner & Witcoff, Ltd.

(57) ABSTRACT

A connector includes at least two terminal fittings, a connector housing including terminal accommodating chambers which respectively accommodate the at least two terminal fittings, and a shorting terminal electrically connecting the at least two terminal fittings to each other. An electrical connection of the at least two terminal fittings is released by a mating connector which is fitted on the connector. Abutment portions provided at front ends of shorting contact pieces of the shorting terminal project from a front surface of the connector housing. A front surface of the mating connector facing a front surface of the connector housing presses against the abutment portions and deflects the shorting contact pieces in a rear direction of the connector so as to release shorting of the at least two terminal fittings.

5 Claims, 12 Drawing Sheets

(56) References Cited

U.S. PATENT DOCUMENTS

| | | | | |
|---|---|---|---|---|
| 6,942,510 | B2 * | 9/2005 | Nakamura | H01R 13/7032 439/188 |
| 6,953,364 | B2 * | 10/2005 | Nakamura | H01R 13/7031 439/352 |
| 7,901,229 | B2 * | 3/2011 | Nakamura | H01R 13/641 439/188 |
| 7,955,104 | B1 * | 6/2011 | Wicks | H01R 13/7032 439/188 |
| 2003/0022542 | A1 | 1/2003 | Nakamura et al. | |
| 2003/0060078 | A1 | 3/2003 | Kashiyama et al. | |
| 2016/0190750 | A1 * | 6/2016 | Shinmi | H01R 13/7032 439/188 |

* cited by examiner

CONNECTOR

CROSS REFERENCE TO RELATED APPLICATIONS

This application claims priority from Japanese Patent Application No. 2016-198446 filed on Oct. 6, 2016, the entire contents of which are incorporated herein by reference.

BACKGROUND OF THE INVENTION

Field of the Invention

The present invention relates to a connector including a shorting terminal which can short a pair of terminals.

Description of Related Art

For example, a connector for use in connecting a circuit to an air bag inflator normally includes a shorting terminal and a shorting releasing member to prevent a malfunction of the inflator that would be triggered by static electricity when fitting together a female connector housing and a male connector housing (for example, refer to Patent Literature 1: JP-A-2002-305057). A shorting metallic part (a shorting terminal) connects two poles, while shorting them, which connect to the inflator in such a way that no potential difference is generated between the two poles which connect to the inflator until the fitting connection of the female and male connector housings is completed. An insulation piece (a shorting releasing member) pushes up the shorting metallic part to release the shorted state between the two poles when the fitting connection of the female and male connector housings is completed.

For example, in the case of a connector which is disclosed in Patent Literature 2 (JP-A-2003-36944), a bearing piece, which extends obliquely, is formed at a distal end of a shorting terminal which is provided on one of a pair of connector housings, and a pushing portion is provided on the other connector housing so as to displace the bearing piece towards a side wall portion of the other connector housing so that the shorting terminal is elastically deflected in a direction in which the shorting terminal is caused to move away from a terminal metallic part in a fitting process of fitting together the pair of connector housings.

[Patent Literature 1] JP-A-2002-305057

[Patent Literature 2] JP-A-2003-36944

According to a related art, an inserting opening into which an insulating piece is inserted has to be provided in a connector housing on which a shorting metallic part is provided, while the insulating piece has to be provided on the mating connector housing so as to project therefrom, which makes the configurations of molds for the female and male connector housings complex, resulting in a problem that the production costs are increased.

In addition, according to a related art, a bearing piece of a shorting terminal has to be displaced towards a side wall portion of the other connector housing (sideways), and a clearance portion (a gap) has to be provided on the side wall portion of the connector housing so as to avoid any interference with the displaced bearing piece, leading to a problem that an enlargement in size of the connector is called for.

SUMMARY

One or more embodiments provide a connector which can not only reduce the production costs by preventing the configurations of molds for connector housings from becoming complex but also release well a pair of metallic parts from a shorted state without calling for enlargement in size of the connector.

With a view to achieving the object described above, a connector according to the invention is characterized by aspects which will be described below under (1) to (5).

In an aspect (1), one or more embodiments provide a connector including at least two terminal fittings, a connector housing including terminal accommodating chambers which respectively accommodate the at least two terminal fittings, and a shorting terminal electrically connecting the at least two terminal fittings to each other. An electrical connection of the at least two terminal fittings is released by a mating connector which is fitted on the connector. Abutment portions provided at front ends of shorting contact pieces of the shorting terminal project from a front surface of the connector housing. A front surface of the mating connector facing a front surface of the connector housing presses against the abutment portions and deflects the shorting contact pieces in a rear direction of the connector so as to release shorting of the at least two terminal fittings.

In an aspect (2), the shorting contact pieces are deflected in the rear direction of the connector by the front surface of the mating connector and respectively brought into contact with projecting portions, the shorting contact pieces are displaced to positions in which the shorting contact pieces separate from the at least two terminal fittings so as to release contact of the shorting contact pieces with the at least two terminal fittings. The projecting portions are formed on the terminal accommodating chambers and capable of abutting to the shorting contact pieces.

In an aspect (3), the shorting contact pieces include contact portions which project towards terminal box portions of the at least two terminal fittings and which are brought into contact with the terminal box portions respectively. The shorting contact pieces are deflected in the rear direction of the connector by the front surface of the mating connector and the contact portions are displace to positions in which the contact portions separate from the terminal box portions so as to release the contact of the shorting contact pieces with the terminal box portions.

In an aspect (4), the shorting contact pieces include contact portions which project towards terminal box portions of the at least two terminal fittings and which are brought into contact with the terminal box portions respectively. The shorting contact pieces are deflected in the rear direction of the connector by the front surface of the mating connector and the contact portions are displace to non-contact recess portions formed on the terminal box portions so as to release the contact of the shorting contact pieces with the terminal box portions.

In an aspect (5), the shorting terminal includes a first shorting terminal and a second shorting terminal. The first shorting terminal is electrically connected with one of at lease the two terminal fittings. The second shorting terminal is electrically connected with another of the at least two terminal fittings. A contact portion of the first shorting terminal and a contact portion of the second shorting terminal are brought into contact with each other so that the first shorting terminal and the second shorting terminal are electrically connected each other. An abutment portion provided at a front end of the shorting contact piece of the first shorting terminal projects from the front surface of the connector housing. The front surface of the mating connector facing the front surface of the connector housing presses against the abutment portion and the shorting contact piece is deflect in the rear direction of the connector and the contact portion of the first shorting terminal is displaced to a position in which the contact portion of the first shorting terminal separates away from the contact portion of the second shorting terminal so as to release the shorting of the two terminal fittings.

According to the aspect (1), when the connector is fitted in the mating connector, the abutment portions of the shorting contact pieces of the shorting terminal which project from the front surface of the connector housing are pressed against by the front surface of the mating connector, whereby the shorting contact pieces of the shorting terminal are deflected to the rear of the connector to thereby release the shorting of the two terminal fittings.

Thus, a shorting releasing member does not have to be provided on the front surface of the mating connector, and an inserting opening into which the shorting releasing member is inserted does not have to be provided on the connector housing. Consequently, it is possible to reduce the production costs by preventing the configurations of molds for both the connector housings from becoming complex.

Additionally, the shorting contact pieces of the shorting terminal are not displaced greatly sideways of the connector housing. Thus, since a clearance (a gap) configured to avoid an interference with the shorting contact piece which is displaced does not have to be provided on side wall portions of the connector housing in order to avoid the interference with the shorting contact pieces, an enlargement in size of the connector is not called for.

According to the aspect (2), since the shorting contact pieces which are deflected towards the rear of the connector are brought into contact with the projecting portions (the terminal positioning portions which position the terminal fittings at the front thereof) which are formed in the terminal accommodating chambers so as to be brought into abutment with the shorting contact pieces and are then displaced to the positions where the shorting contact pieces lie away from the terminal fittings, the shorting of the terminal fittings is released in a more ensured fashion.

According to the aspect (3), on the shorting contact pieces which are deflected to the rear of the connector, since the contact portions which project towards the terminal box portions are displaced to the positions where the contact portions lie away from the terminal box portions to thereby release the contact with the terminal box portions, the electrical connection of the two terminal fittings and the shorting thereof are performed smoothly.

According to the aspect (4), on the shorting contact pieces which are deflected to the rear of the connector, the contact portions which project towards the terminal box portions are displaced to the non-contact recess portions which are formed on the terminal box portions, the electrical connection of the two terminal fittings and the shorting thereof are performed more smoothly.

According to the aspect (5), when the connector is fitted in the mating connector, the abutment portion of the shorting contact piece of the first shorting terminal which projects from the front surface of the connector housing is pressed against by the front surface of the mating connector, whereby the contact portion of the first shorting terminal is deflected to the position where the contact portion of the first shorting terminal lies away from the contact portion of the second shorting terminal to thereby release the shorting of the two terminal fittings.

Then, in the shorting terminal configured in the way described above, the contact portion of the first shorting terminal can be spaced away from the contact portion of the second shorting terminal according to the fitting stroke over which the connector is fitted into the mating connector. Thus, with the connector configured in the way described above, the shorting of the two terminal fittings can be released in a more ensured fashion, and a high degree of freedom in designing the construction thereof can be provided.

According to the invention, it is possible to provide the connector which can not only reduce the production costs by preventing the configurations of molds for the connector housings from becoming complex but also release well the pair of metallic parts from the shorted state without calling for enlargement in size of the connector.

Thus, the invention has been described briefly. The invention will be clarified in detail by perusing modes for carrying out the invention (hereinafter, referred to as embodiments) which will be described below by reference to accompanying drawings.

DETAILED DESCRIPTION

Hereinafter, an embodiment of the invention will be described by reference to the drawings (a first embodiment).

Figure 1:
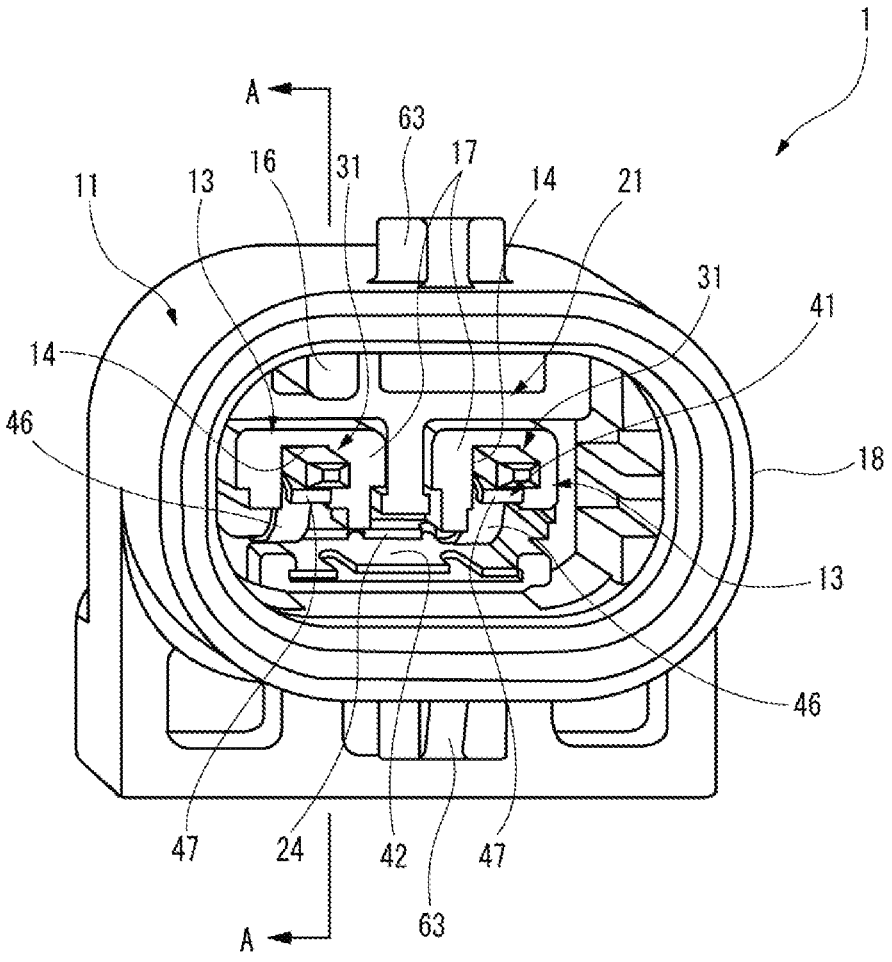
FIG. 1 is a perspective view of a connector according to a first embodiment of the invention.
Figure 2:
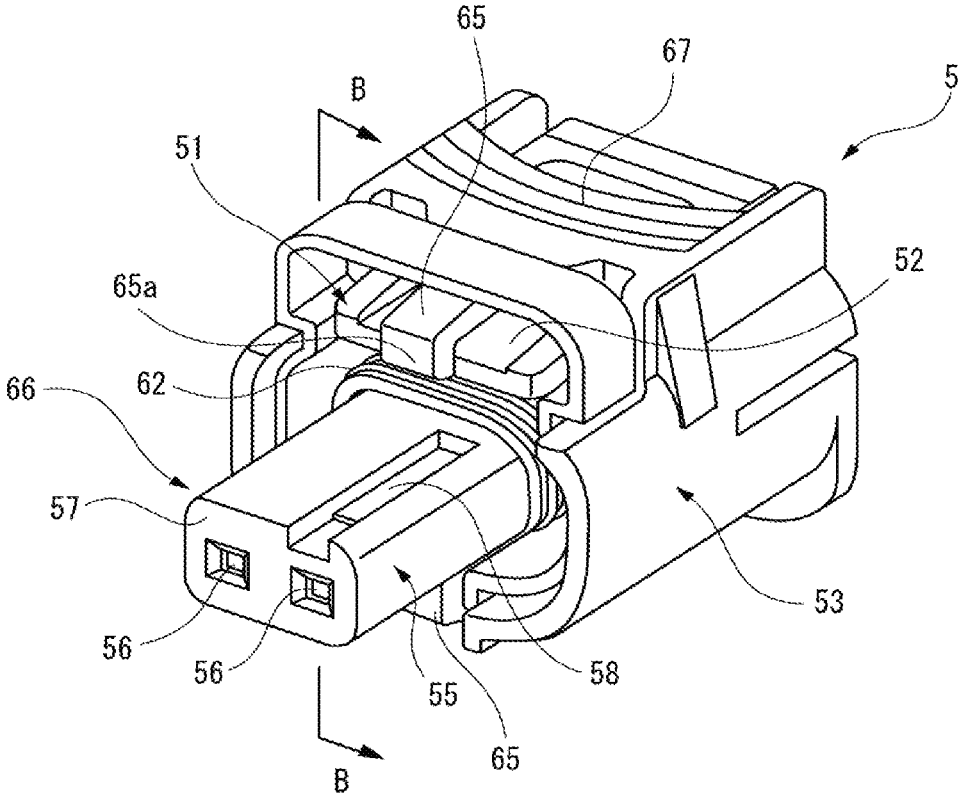
FIG. 2 is a perspective view of a mating connector which is fitted on the connector shown in FIG. 1.
Figure 3:
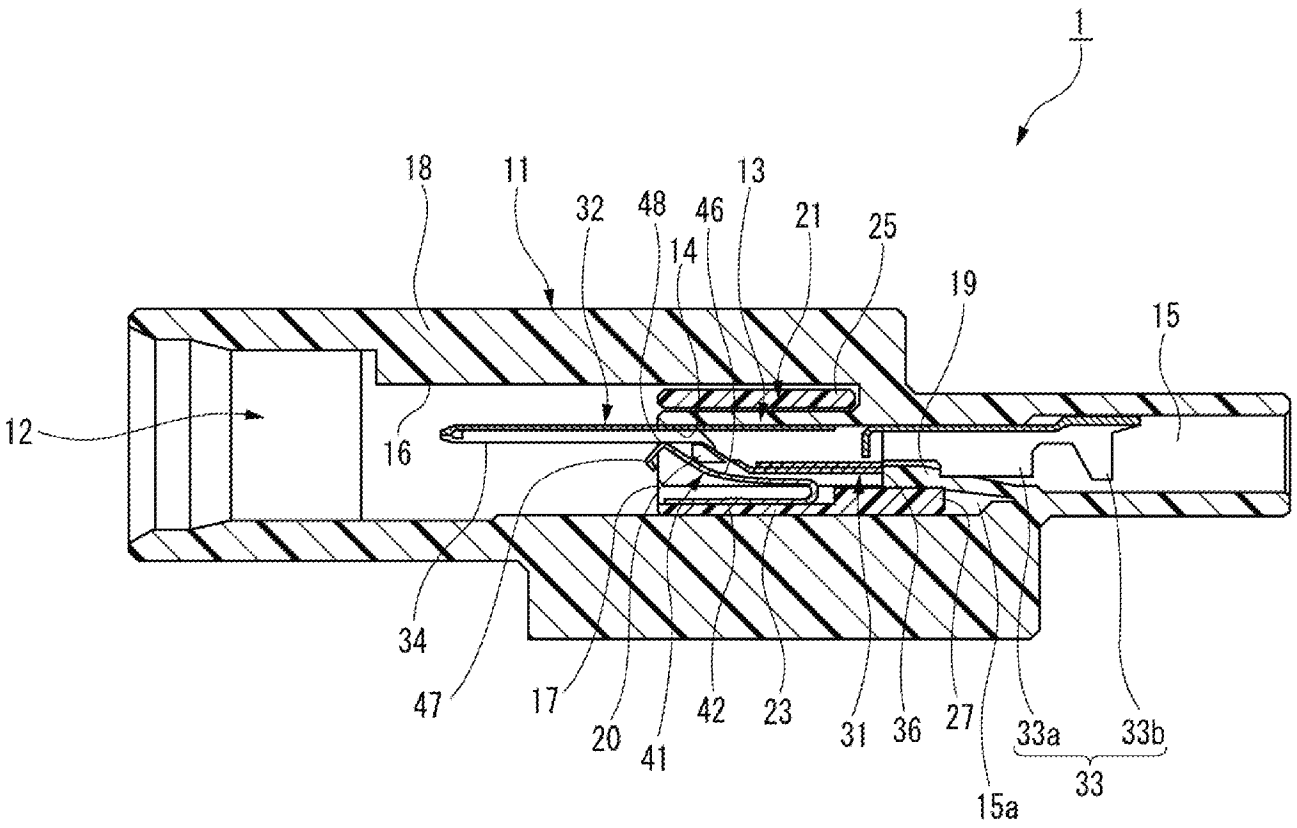
FIG. 3 is a sectional view of the connector shown in FIG. 1 which is taken along a line A-A.
Figure 4:
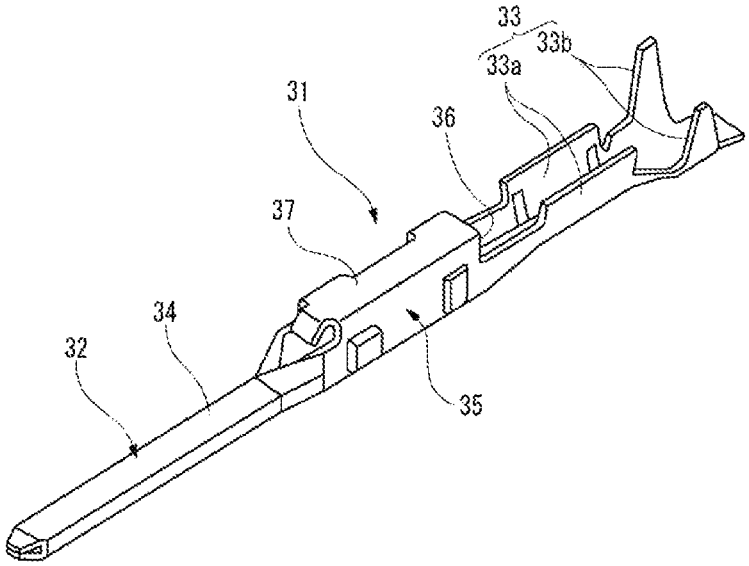
FIG. 4 is a perspective view of a metallic terminal part for use in the connector shown in FIG. 1.

FIGS. 1 and 2 are perspective views of a connector 1 and a mating connector 5, respectively, according to a first embodiment of the invention. FIG. 3 is a sectional view of the connector 1 shown in FIG. 1 taken along a line A-A. FIG. 4 is a sectional view of the mating connector 5 shown in FIG. 2 taken along a line B-B.

As shown in FIGS. 1 and 3, the connector 1 according to the first embodiment includes a pair of male terminals (terminal fittings) 31, a male housing 11 which is a connector housing having terminal accommodating chambers 15 which accommodate individually the pair of male terminals 31 and a shorting terminal 41 which connects electrically the pair of male terminals 31 together.

As shown in FIG. 4, the male terminal 31 is fabricated as a metallic terminal part of a thin elongated configuration in a front-rear or longitudinal direction by bending a sheet of metal of a predetermined shape which is produced by punching out a sheet of conductive metal such as copper or copper alloy. A tab-shaped electric connecting portion 32 is formed at a distal end side of the male terminal 31, while a solderless crimping portion 33 is provided at a rear end side thereof where an electric wire, not shown, is pressure connected to the male terminal 31. Then, a rectangular parallelepiped terminal box portion 35 is formed between the electric connecting portion 32 and the solderless crimping portion 33.

An end portion of a sheathed electric wire in which a conductor is covered with a sheathing therearound is pressure connected to the solderless crimping portion 33 for electric energization. The solderless crimping portion 33 has a conductor crimping portion 33*a* and a sheathing crimping portion 33*b*. The conductor crimping portion 33*a* is crimped onto a portion of the conductor which is exposed from the sheathing, and the sheathing crimping portion 33*b* is crimped onto the sheathing.

The male housing 11 is formed from a synthetic resin having electrical insulating properties, and a distal end side thereof is formed as a fitting recess portion 12. The male housing 11 is made up or a male housing main body portion 13 and an elliptically cylindrical hood portion 18 which surrounds the male housing main body portion 13. The terminal accommodating chambers 15 are formed in the male housing main body portion 13 so as to accommodate individually the pair of male terminals 31.

The pair of terminal accommodating chambers 15 are formed along a fitting direction in which the connector 1 is fitted into the mating connector 5 and are provided so as to be aligned side by side in a widthwise direction of the male connector housing 11. Each of the terminal accommodating chambers 15 has an opening portion 14 on a distal end side of the male housing main body portion 13. In circumferential walls which define the opening portion 14, a wall portion which faces an upper surface 34 of the electric connecting portion 32 of the male terminal 31 is formed further rearwards than the other wall portions so as to act as a terminal positioning portion 20 which is brought into abutment with a front portion of the terminal box portion 35 of the male terminal 31 which is inserted into the terminal accommodating chamber 15 from the rear thereof to thereby position the male terminal 31 at the front thereof. The terminal positioning portion 20 also functions as a projecting portion which can be brought into abutment with a shorting contact piece 46 of the shorting terminal 41 from a rear side thereof.

Each of the terminal accommodating chambers 15 in the male housing main body portion 13 has a male terminal lance 19 which is a deflectable engagement piece which projects inwards of the terminal accommodating chamber 15 from a side surface thereof. The male terminal lance 19 is formed as a cantilever part which extends to the front, and a distal end side thereof enters an interior of the terminal accommodating chamber 15. A deflection space 15*a* is provided at an opposite end side of the male terminal lance 19 to the end side thereof which enters the terminal accommodating chamber 15 so that the male terminal lance 19 can be deflected downwards when the male terminal lance 19 is pressed downwards by the terminal box portion 35 of the male terminal 31. Then, the male terminal 31 is prevented from being dislocated from the terminal accommodating chamber 15 by a rear end portion 36 of the terminal box portion 35 being locked by the male terminal lance 19.

The tab-shaped electric connecting portion 32 of the male terminal 31 projects to the front from the opening portion 14 of the terminal accommodating chamber 15 to face an interior of the hood portion 18 and is made to connect with a female terminal 61 of the mating connector 5. An elongated projection 16 is formed on an inner wall of the hood portion 18 so that a guide groove 58 provided on a female housing 51 is brought into engagement with the elongated projection 16 so as to guide a fitting motion of the female housing 51.

A locking projection 63 is provided at a center of each of upper and lower sides of an outer circumferential surface of the hood portion 18 so as to project therefrom, so that the locking projections 63 are brought into engagement individually with a pair of locking arms 65 which are formed at upper and lower portion of the mating connector 5.

A front holder 21 in which the shorting terminal 41 is installed is fitted between an outer circumferential wall of the male housing main body portion 13 which is situated deep inside the hood portion 18 and an inner circumferential wall of the hood portion 18. The shorting terminal 41 installed in the front holder 21 is disposed adjacent to the male terminals 31 which are accommodated individually in the pair of terminal accommodating chambers 15 so as to connect electrically the electric connecting portions 32 together to thereby connect electrically the pair of male terminals 31 together while shorting them.

Figure 5:
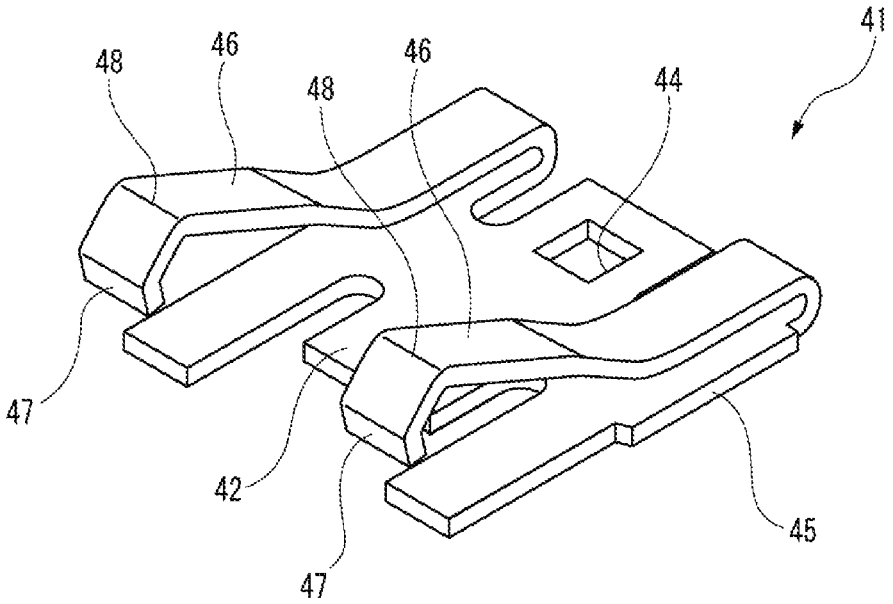
FIG. 5 is a perspective view of a shorting terminal for use in the connector according the first embodiment of the invention.

The shorting terminal 41 is a terminal which is formed by pressing a sheet of metal and includes, as shown in FIG. 5, a rectangular terminal main body 42 and two shorting contact pieces 46 which are provided on both sides of the terminal main body 42 so as to extend from a rear end (a right end in FIG. 5) thereof.

The terminal main body 42 includes supported portions 45 which are provided on left and right side edges thereof so as to project therefrom and a locking hole 44 which is opened in a centrally rear end position thereof.

As shown in FIGS. 1 and 3, the shorting contact piece 46 is formed so that it is bent back into a U-like shape from a rear end of the terminal main body 42, extends obliquely towards the electric connecting portion 32 of the male terminal 31 and projects from a front surface 17 of the male housing main body portion 13 at a distal end.

A projecting bent portion 48 is formed at a free end portion of the shorting contact piece 46 which is brought into contact with the electric connecting portion 32 of the male terminal 31 by bending the free end portion so as to project towards the male terminal 31. Additionally, an abutment portion 47 is formed at a front end of the shorting contact piece 46 which projects from the front surface 17 of the male housing main body portion 13 by bending the front end.

Figure 6:
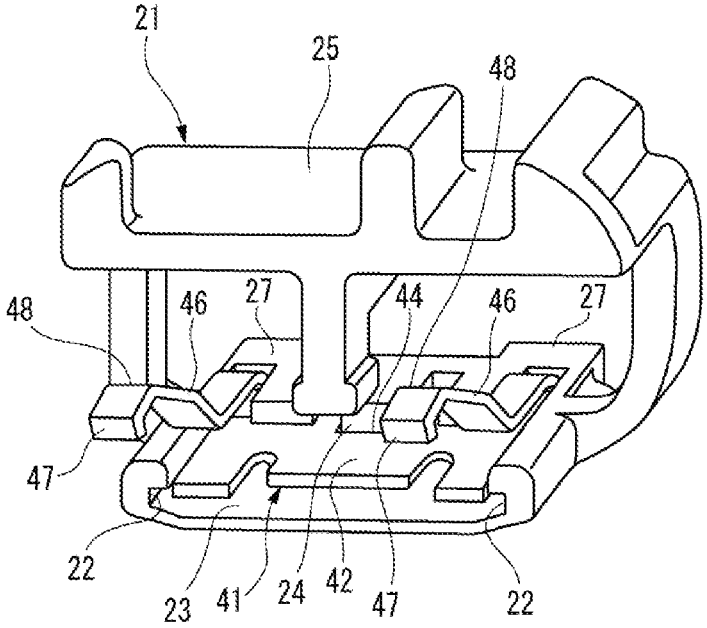
FIG. 6 is a perspective view of a front holder in which the shorting terminal shown in FIG. 1 is installed.

The front holder 21 is formed from a synthetic resin having electrical insulating properties and has, as shown in FIG. 6, a supporting plate portion 23 on which the terminal main body 42 of the shorting terminal 41 is placed and an upper wall portion 25 which is disposed so as to face an upper surface of the supporting plate portion 23. The front holder 21 is formed into a frame-like configuration by connecting left and right end sides of the supporting plate portion 23 and the upper wall portion 25 together.

Supporting grooves 22 are provided on both left and right side edges of the supporting plate portion 23 in an opposing fashion to each other and hold the corresponding supported portions 45 provided on the left and right side edges of the terminal main body 42 in a thickness-wise direction. A locking arm 24 is provided at a central portion of the supporting plate portion 23 so as to extend to the front from a rear end thereof to lock the locking hole 44 in the terminal main body 42. Then, when the terminal main body 42 of the shorting terminal 41 is inserted from the front along an upper surface of the supporting plate portion 23 with the supported portions 45 provided on the left and right side edges of the terminal main body 42 being guided by the corresponding supporting grooves 22 to reach a predetermined position, the locking hole 44 is locked by the locking arm 24, whereby the shorting terminal 41 is prevented from being dislocated from the front holder 21.

A pair of lance restricting portions 27 are provided at the rear of the supporting plate portion 23 of the front holder 21 so as to correspond individually to the terminal accommodating chambers 15. When the front holder 21 is fitted in the male housing main body portion 13, the lance restricting portions 27 are inserted into the deflection spaces 15*a* (refer to FIG. 3). When inserted into the deflection space 15*a*, the lance restricting portion 27 restricts the male terminal lance 19 with which the male terminal 31 is fixed in place in the terminal accommodating chamber 15 from moving in a lock releasing direction to ensure further the fixing of the male terminal 31 in the terminal accommodating chamber 15. The front holder 21 is fixed in the male housing main body portion 13 by a locking structure, not shown, so as to take a temporary locking position where the male terminal lances 19 are allowed to move in the lock releasing direction and a permanent locking position where the male terminal lances 19 are restricted from moving in the lock releasing direction.

Then, when the front folder 21 is fitted in the male housing main body portion 13, the shorting terminal 41 installed in the front folder 21 is disposed so as to be adjacent to upper surface sides (a lower side in FIG. 3) of the male terminals 31. In this state, the shorting contact pieces 46 of the shorting terminal 41 are disposed further forwards than the terminal positioning portions 20 of the male housing main body portion 13, and the bent portions 48 are in contact with the upper surfaces 34 of the electric connecting portions 32, the abutment portions 47 at the front ends of the shorting contact pieces 46 projecting from the front surface 17 of the male housing main body portion 13. Consequently, the shorting terminal 41 connects electrically the two male terminals 31 together while shorting them.

Next, the mating connector 5 which is fitted on the connector 1 will be described.

Figure 7:
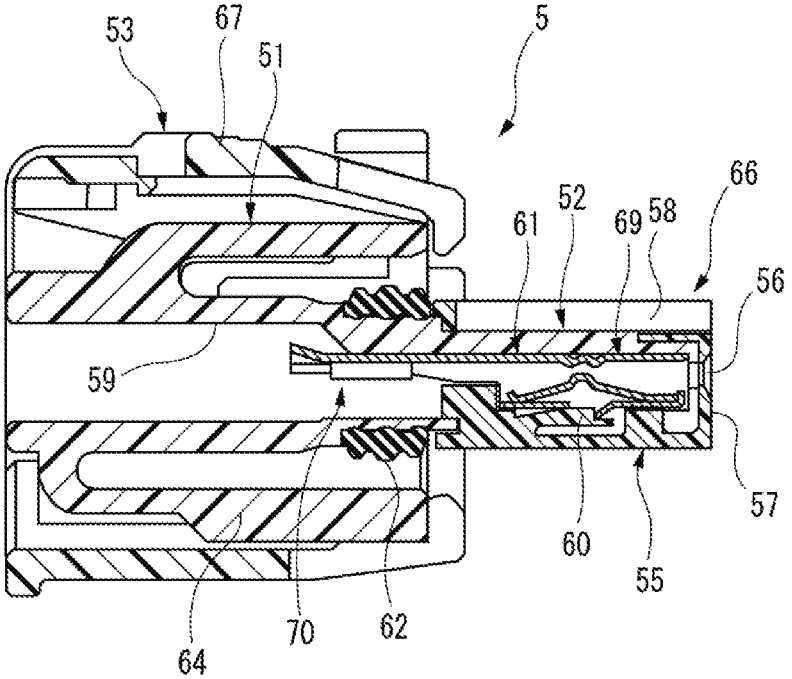
FIG. 7 is a sectional view of the mating connector shown in FIG. 2 which is taken along a line B-B.

As shown in FIGS. 2 and 7, the mating connector 5 includes a pair of female terminals 61, the female housing 51 which is a mating connector housing having a pair of terminal accommodating chambers 59 which accommodate individually the female terminals 61, and a locking housing 53 having the pair of locking arms 65 which restrict the female housing 51 from being dislocated from the male housing 11 once the female housing 51 is fitted on the male housing 11.

The female terminal 61 is fabricated as a metallic terminal part of a thin elongated configuration in the longitudinal direction by bending a sheet of metal of a predetermined shape which is produced by punching out a sheet of conductive metal such as copper or copper alloy. An angular cylindrical electric connecting portion 69 is formed at a distal end side of the female terminal 61, while a solderless crimping portion 70 is provided at a rear end side thereof where an electric wire, not shown, is pressure connected to the female terminal 61.

The female housing 51 is divided into two parts which are a housing main body 52 and a front holder 55. The housing main body 52 and the front holder 55 are formed as separate parts and are then assembled together to define a pair of terminal accommodating chambers 59. The pair of terminal accommodating chambers 59 are formed along a fitting direction in which the mating connector 5 is fitted on the connector 1 and are provided so as to be aligned side by side in a width-wise direction of the female housing 51.

As shown in FIG. 7, the guide groove 58 which is brought into engagement with the elongated projection 16 on the hood portion 18 so as to guide the elongated projection 16 therealong when the female housing 51 is fitted on the male housing 11, a front wall 57 having a pair of terminal inserting openings 56 into which the tab-shaped electric connecting portions 32 of the male terminals 31 are inserted, and female terminal lances 60 which are deflectable locking pieces which project into interiors of the terminal accommodating chambers 59 to lock the female terminals 61 so as to prevent them from being dislocated from the corresponding terminal accommodating chambers 59 are formed on the front holder 55 which is formed from a synthetic resin having electric insulating properties.

The housing main body 52 is formed through injection molding in which a synthetic resin having electric insulating properties is injected so as to forma cutout portion at a front end portion thereof. The front folder 55 is assembled into the cutout portion of the housing main body 52 to make up a fitting portion 66 which is fitted into the fitting recess portion 12 of the male housing 11.

Additionally, the housing main body 52 has a hood portion 64 which surrounds an outer circumference of the hood portion 18 of the male housing 11, and a waterproof packing 62 is installed on an outer circumferential surface of the fitting portion 66 which faces an inner circumferential surface of the hood portion 18 of the male housing 11. A space between the fitting recess portion 12 of the male housing 11 and the fitting portion 66 of the female housing 51 is sealed up in a fluid-tight fashion by the waterproof packing 62.

The locking housing 53 is formed from a synthetic resin having electric insulating properties and is installed so as to surround an outer circumference of the housing main body 52. Once the connector 1 and the mating connector 5 are fitted together, the pair of locking arms 65 which are formed on the upper and lower portions of the locking housing 53 restrict the connector 1 and the mating connector 5 from being dislocated from each other by locking portions 65*a* which are formed individually at distal end portions of the locking arms 65 which extend to the front along the connector fitting direction being brought into engagement with the locking projections 63 formed on the male housing 11. In releasing the locked fitting of the connector 1 and the mating connector 5, a releasing control portion 67 at the rear of the locking arm 65 is depressed to cause the locking portions 65*a* to be dislocated from the locking projections 63 to thereby release the locked fitting of the connector 1 and the mating connector 5.

Next, a fitting process of fitting the connector 1 into the mating connector 5 will be described.

Figure 8:
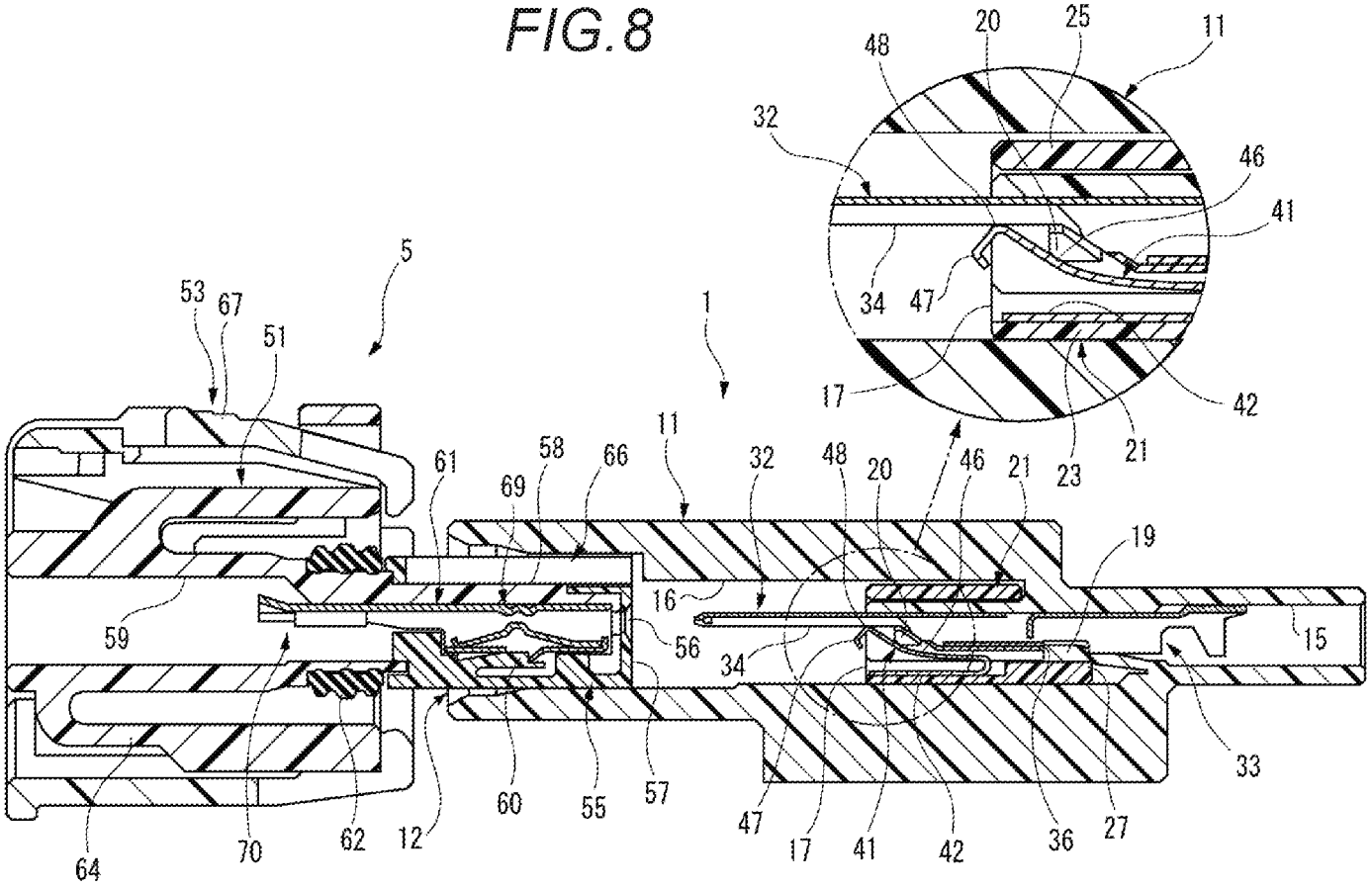
FIG. 8 shows a vertical and longitudinal sectional view and a main part enlarged sectional view, showing an initial state of a fitting process of fitting the connector into the mating connector according to the first embodiment.
Figure 9:
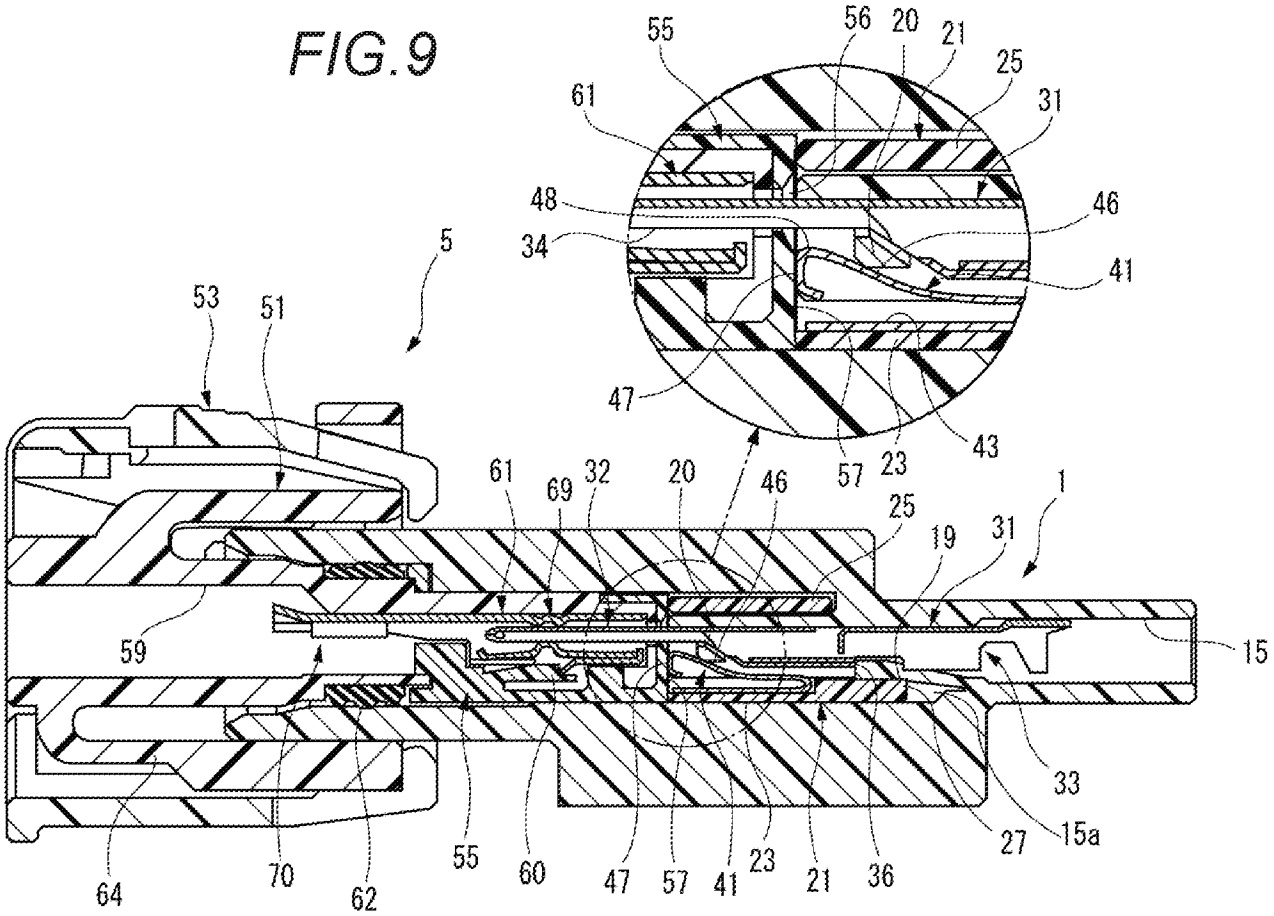
FIG. 9 shows a vertical and longitudinal sectional view and a main part enlarged sectional view, showing a completed state of the fitting process of fitting the connector into the mating connector according to the first embodiment.

FIGS. 8 and 9 show vertical and longitudinal sectional views and main part enlarged sectional views, showing an initial state and a completed state of the fitting process of fitting the connector 1 into the mating connector 5, respectively.

Firstly, a distal end of the male housing 11 of the connector 1 is caused to move towards a distal end of the female housing 51 of the mating connector 5 so as to fit the connector 1 into the mating connector 5. Then, as shown in FIG. 8, the fitting portion 66 of the female housing 51 is inserted into the fitting recess portion 12 of the male housing 11. Then, the guiding elongated projection 16 on the male housing 11 enters the guide groove 58 of the female housing 51, whereby the connector 1 is guided into the mating connector 5 along the fitting direction.

When the female housing 51 is inserted into the male housing 11 in this state, as shown in FIG. 9, the male terminals 31 of the male housing 11 are inserted into the electric connecting portions 69 of the female terminals 61 from the terminal inserting openings 56 at a distal end side of the female housing 51, whereby the female terminals 61 and the male terminals 31 are electrically connected together.

As this occurs, the abutment portions 47 of the shorting contact pieces 46 of the shorting terminal 41 which project from the front surface 17 of the housing main body portion 13 which constitutes a front surface of the male housing 11 are pressed against by the front wall 57 of the front holder 55 which constitutes a front surface of the mating connector 5, and this deflects the shorting contact pieces 46 of the shorting terminal 41 towards the rear of the connector (towards the right in FIG. 9), whereby the shorting of the two male terminals 31 is released.

Namely, the abutment portions 47 which are provided at front ends of the shorting contact pieces 46 which extend obliquely towards the corresponding electric connecting portions 32 of the male terminals 31 are pressed against to the rear, whereby the portions of the shorting contact pieces 46 which are bent back into the U-like shape are elastically deformed to the rear, and the free end portions of the shorting contact pieces 46 are displaced towards the terminal main body 42. Then, the bent portions 48, which are formed so as to be bent at the free end portions of the shorting contact pieces 46, move away from the upper surfaces 34 of the electric connecting portions 32, whereby the male terminals 31 are de-energized. Then, the shorting of the two adjacent male terminals 31 by the shorting terminal 41 is released.

When the connector 1 and the mating connector 5 are disconnected from each other, the pressing against the abutment portions 47 by the front wall 57 of the mating connector 5 is released, whereby the bent portions 48 of the shorting contact pieces 46 are brought into contact with the upper surfaces 34 of the electric connecting portions 32. As a result of this, shorting terminal 41 is brought into contact with the two male terminals 31 to short them again.

Thus, as has been described heretofore, according to the connector 1 of the first embodiment, a shorting releasing member does not have to be provided on the front surface of the female housing 51 of the mating connector 5 (the front wall 57 of the front holder 55) so as to project therefrom, and an inserting opening into which the shorting releasing member is inserted does not have to be provided in the male housing main body 13 of the male housing 11 of the connector 1. Consequently, the configurations of molds for the male housing 11 and the female housing 51 are prevented from becoming complex, thereby making it possible to reduce the production costs.

In addition, the shorting contact pieces 46 of the shorting terminal 41 are prevented from being displaced greatly towards the male housing 11, and therefore, a clearance portion (a gap) which avoids the interference of the male housing 11 with the shorting contact pieces 46 which are displaced does not have to be provided on the male housing 11 to avoid the interference of the male housing 11 with the shorting contact pieces 46. Thus, an enlargement in size of the connector 1 is not called for.

Further, according to the connector 1 of the first embodiment, the shorting contact pieces 46 which are deflected to the rear of the connector are brought into contact with the terminal positioning portions 20 which are formed in the terminal accommodating chambers 15 so as to be brought into abutment with the corresponding shorting contact pieces 46 and are then displaced to the positions where the shorting contact pieces 46 lie away from the male terminals 31. Thus, the shorting of the two male terminals 31 is released in a more ensured fashion.

Second Embodiment

Figure 10:
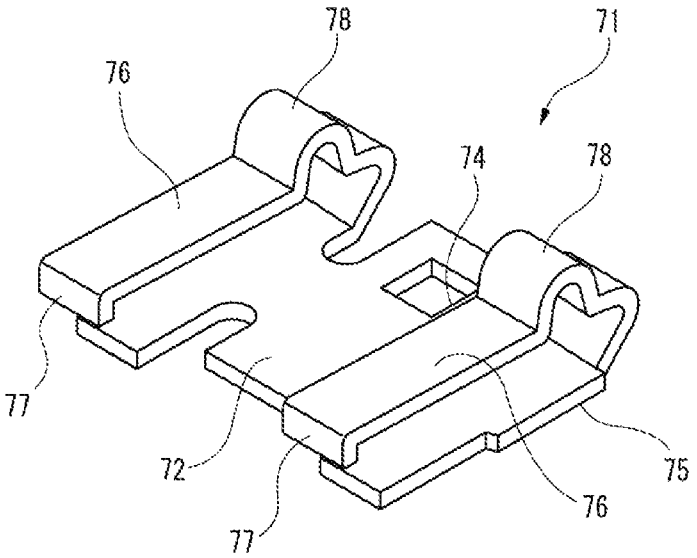
FIG. 10 is a perspective view of a shorting terminal for use in a connector according to a second embodiment of the invention.
Figure 12A:
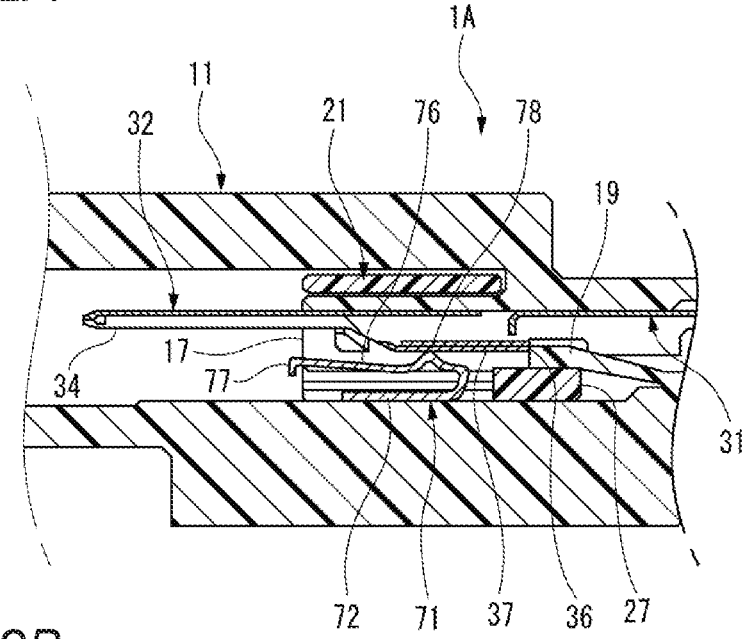
FIG. 12A is a main part enlarged sectional view of the connector which uses the shorting terminal shown in FIG. 10.
Figure 12B:
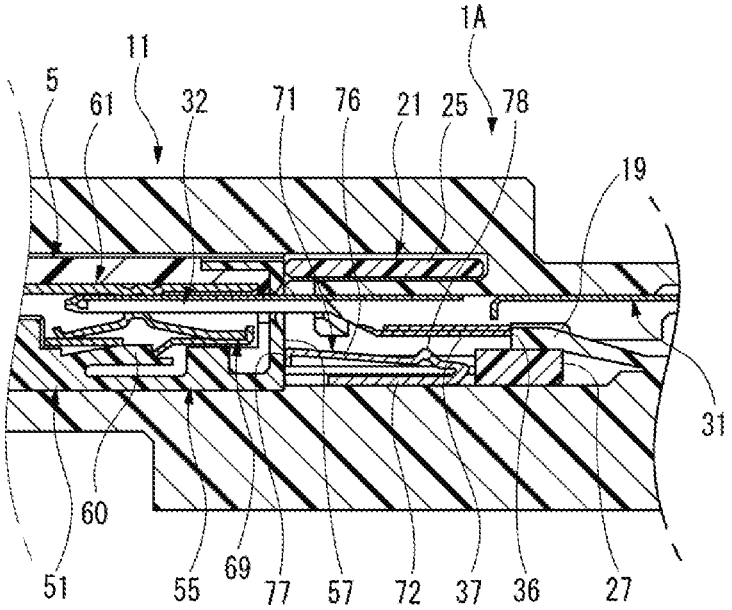
FIG. 12B is a main part enlarged sectional view showing a fitting completed state in which the connector using the shorting terminal shown in FIG. 10 is completely fitted into a mating connector.

FIG. 10 is a perspective view of a shorting terminal 71 for use in a connector 1A according to a second embodiment of the invention. FIG. 12A is a main part enlarged sectional view of the connector 1A which uses the shorting terminal 71 shown in FIG. 10, and FIG. 12B is a main part enlarged sectional view showing a fitting completed state in which the connector 1A using the shorting terminal 71 shown in FIG. 10 is completely fitted into a mating connector 5. Like reference numerals will be given to like constituent elements to those of the connector 1 according to the first embodiment described above, and a detailed description thereof will be omitted in the following description.

As shown in FIG. 10, the shorting terminal 71 is a terminal which is fabricated by pressing a sheet of metal and includes a rectangular terminal main body 72 and two shorting contact pieces 76 which are disposed individually on both sides of the terminal main body 72 so as to extend from a rear end (a right end in FIG. 10) thereof.

The terminal main body 72 includes supported portion 75 which are provided at left and right side edges of the terminal main body 72 so as to project therefrom and a locking hole 74 which is opened in a centrally rear end position thereof.

As shown in FIG. 12A, the shorting contact piece 76 is formed into such a shape that the shorting contact piece 76 extends rearwards and obliquely upwards from the rear end of the terminal main body 72 and is thereafter bent back into a U-like shape so as to extend to the front substantially horizontally to project from a front surface 17 of a male housing main body portion 13 at a front end thereof.

The shorting contact piece 76 has a contact portion 78 at a portion thereof where the shorting contact piece 76 is brought into contact with a terminal box portion 35 of a male terminal 31, and this contact portion 78 is formed into a curved configuration which projects towards the terminal box portion 35 of the male terminal 31. Further, an abutment portion 77 is formed at a front end of the shorting contact piece 76 which projects from the front surface 17 of the male housing main body portion 13 by bending a front end portion the shorting contact piece 76.

Then, as with the shorting terminal 41 of the first embodiment, the shorting terminal 71 is inserted into a front holder 21 from the front of the front holder 21 along an upper surface of a supporting plate portion 23 with the supported portions 75 being guided in supporting grooves 22 of the front holder 21 therealong and is then installed in the front holder 21 by locking a locking arm 24 in the locking hole 74.

As shown in FIG. 12A, when the front holder 21 is fitted in the male housing main body portion 13, the shorting terminal 71 installed in the front holder 21 is disposed to lie adjacent to an upper surface side of the male terminals 31 (a lower side in FIG. 12A). In this state, the contact portions 78 on the two shorting contact pieces 76 of the shorting terminal 71 are brought into contact with the top surfaces 37 of the terminal box portions 35, and the abutment portions 77 at the front ends of the shorting contact pieces 76 project from the front surface 17 of the male housing main body portion 13. Thus, the shorting terminal 71 electrically connects the two male terminals 31 together while shorting them.

Next, a fitting process of fitting the connector 1A into the mating connector 5 will be described.

As shown in FIG. 12B, when a female housing 51 is inserted into a male housing 11, the male terminals 31 of the male housing 11 are inserted into electric connecting portions 69 of female terminals 61 from terminal inserting openings 56 at a distal end side of the female housing 51, whereby the female terminals 61 and the male terminals 31 are electrically connected together.

As this occurs, the abutment portions 77 of the shorting contact pieces 76 of the shorting terminal 71 which project from the front surface 17 of the male housing main body portion 13 which is a front surface of the male connector housing 11 are pressed against by a front wall 57 of a front holder 55 which constitutes a front surface of the mating connector 5, whereby the shorting contact pieces 76 of the shorting terminal 71 are deflected to the rear of the connector (to the right in FIG. 12B) to thereby release the shorting of the two male terminals 31.

Namely, as a result of the abutment portions 77 which are provided at the front ends of the shorting contact pieces 76 being pushed to the rear of the connector, the portions of the shorting contact pieces 76 which extend rearwards and obliquely upwards and is thereafter bent back into the U-like shape are elastically deformed to the rear, and the shorting contact pieces 76 are displaced towards a terminal main body 42. Then, the contact portions 78 which are formed on the shorting contact pieces 76 move away from the top surfaces 37 of the terminal box portions 35, whereby the male terminals 31 are de-energized. Then, the shorting of the two male terminals 31 which lie adjacent to each other by the shorting terminal 71 is released.

When the fitting of the connector 1A and the mating connector 5 is released, the shorting contact pieces 76 of the shorting terminal 71 are elastically restored as a result of the pressing by the front wall 57 of the mating connector 5 being released, and the contact portions 78 of the shorting contact pieces 76 are brought into contact with the top surfaces 37 of the terminal box portions 35. As a result of this, the shorting terminal 71 is brought into contact with the two male terminals 31 to connect electrically the two male terminals 31 together while shorting them.

Thus, as has been described heretofore, according to the connector 1A of the second embodiment, on the shorting contact pieces 76 which are deflected to the rear of the connector, the contact portions 78 which project towards the terminal box portions 35 are displaced to the positions where the contact portions 78 lie away from the terminal box portions 35, whereby the contact of the contact portions 78 with the terminal box portions 35 is released. Thus, the two terminal fittings 31 are electrically connected together and are released from the shorted state smoothly.

Third Embodiment

Figure 11:
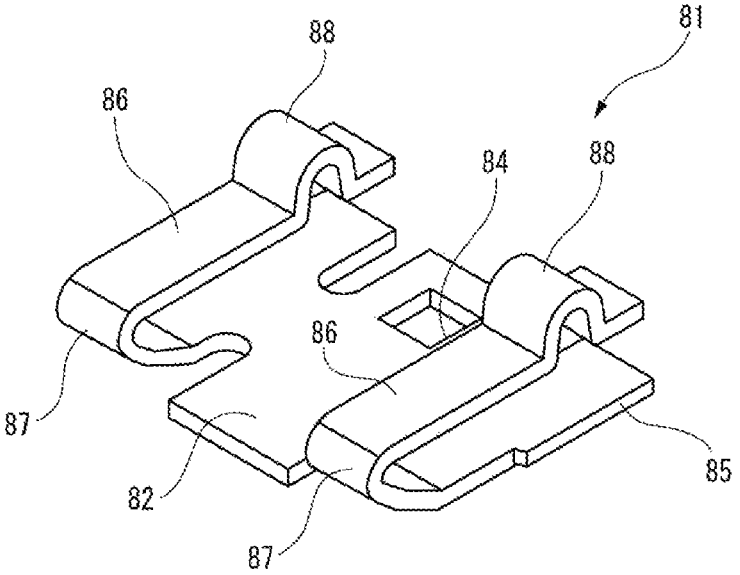
FIG. 11 is a perspective view of a shorting terminal for use in a connector according to a third embodiment of the invention.
Figure 13A:
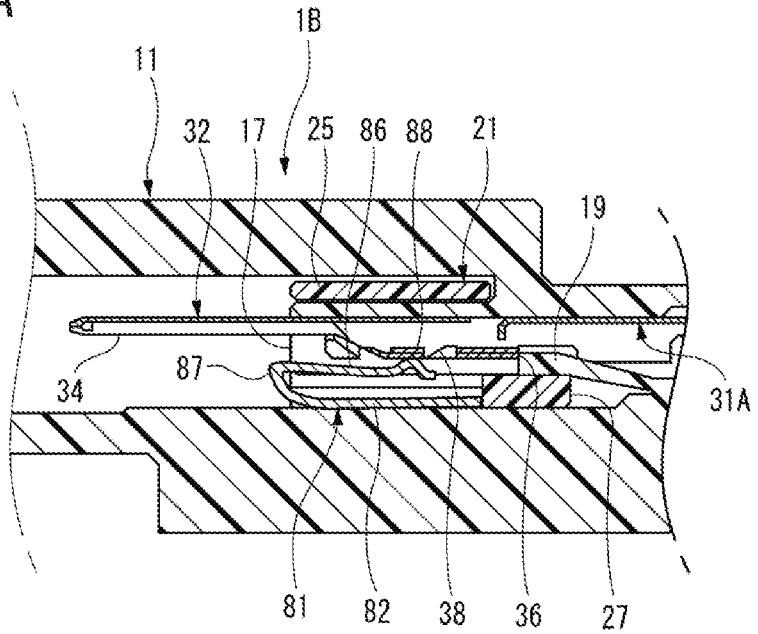
FIG. 13A is a main part enlarged sectional view of the connector which uses the shorting terminal shown in FIG. 11.
Figure 13B:
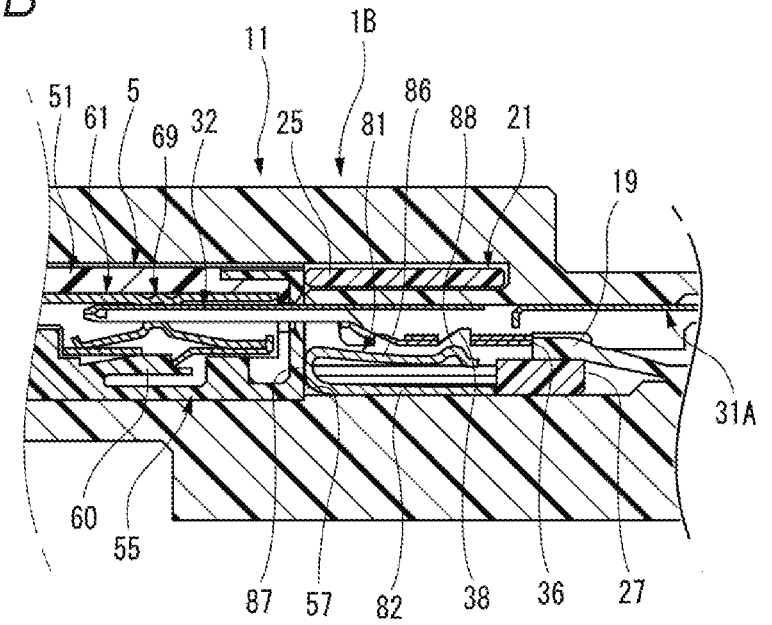
FIG. 13B is a main part enlarged sectional view showing a fitting completed state in which the connector using the shorting terminal shown in FIG. 11 is completely fitted into a mating connector.
Figure 14:
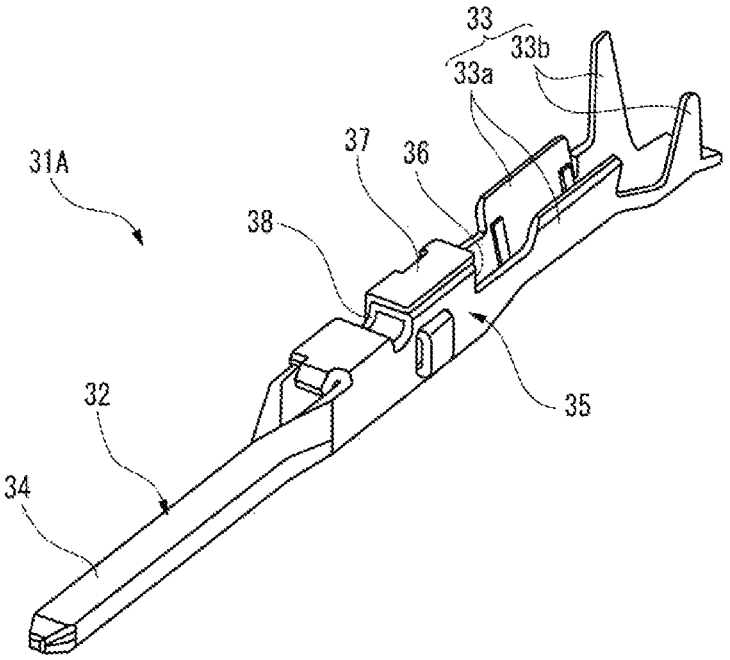
FIG. 14 is a perspective view of a metallic terminal part for use in the connector shown in FIGS. 13A and 13B.

FIG. 11 is a perspective view of a shorting terminal 81 for use in a connector 1B according to a third embodiment of the invention. FIG. 13A is a main part enlarged sectional view of the connector 1B which uses the shorting terminal 81 shown in FIG. 11, and FIG. 13B is a main part enlarged sectional view showing a fitting completed state where the connector 1B using the shorting circuit 81 shown in FIG. 11 is fitted into a mating connector 5. FIG. 14 is a perspective view of a metallic terminal part 31A of the connector 1B. Like reference numerals will be given to like constituent members to those of the connector 1 of the first embodiment described above.

As shown in FIG. 11, the shorting terminal 81 is a terminal fabricated by pressing a sheet of metal and includes a rectangular terminal main body 82 and two shorting contact pieces 86 which are disposed at both sides of the terminal main body 82 and which extend from a front end (a left end in FIG. 11) of the terminal main body 82.

The terminal main body 82 includes supported portion 85 which are provided at left and right side edges of the terminal main body 82 so as to project therefrom and a locking hole 84 which is opened in a central rear end position thereof.

As shown in FIG. 13A, the shorting contact piece 86 is formed into such a shape that the shorting contact piece 86 extends obliquely upwards from a front end of the terminal main body 82 and is thereafter bent back into a U-like shape so as to extend to the rear substantially horizontally to project from a front surface 17 of a male housing main body portion 13 at a front end thereof.

The shorting contact piece 86 which is brought into contact with a terminal box portion 35 of the male terminal 31A has a contact portion 88 which is formed into a curved configuration which projects towards the terminal box portion 35 of the male terminal 31A so as to be brought into contact with a top surface 37 of the terminal box portion 35. Further, a bent portion which is bent back into a U-like shape is formed at a front end of the shorting contact piece 86 which projects from the front surface 17 of the male housing main body portion 13 as an abutment portion 77.

Then, as with the shorting terminal 41 of the first embodiment, the shorting terminal 81 is inserted into a front holder 21 from the front of the front holder 21 along an upper surface of a supporting plate portion 23 with the supported portions 85 being guided in supporting grooves 22 of the front holder 21 therealong and is then installed in the front holder 21 by locking a locking arm 24 in the locking hole 84.

As shown in FIG. 13A, when the front holder 21 is fitted in the male housing main body portion 13, the shorting terminal 81 installed in the front holder 21 is disposed to lie adjacent to an upper surface side of the male terminals 31A (a lower side in FIG. 13A). In this state, the contact portions 88 on the two shorting contact pieces 86 of the shorting terminal 81 are brought into contact with the top surfaces 37 of the terminal box portions 35, and the abutment portions 87 at the front ends of the shorting contact pieces 86 project from the front surface 17 of the male housing main body portion 13. Thus, the shorting terminal 81 electrically connects the two male terminals 31A together while shorting them.

Next, a fitting process of fitting the connector 1B into the mating connector 5 will be described.

As shown in FIG. 13B, when a female housing 51 is inserted into a male housing 11, the male terminals 31A of the male housing 11 are inserted into electric connecting portions 69 of female terminals 61 from terminal inserting openings 56 at a distal end side of the female housing 51, whereby the female terminals 61 and the male terminals 31A are electrically connected together.

As this occurs, the abutment portions 87 of the shorting contact pieces 86 of the shorting terminal 81 which project from the front surface 17 of the male housing main body portion 13 which is a front surface of the male connector housing 11 are pressed against by a front wall 57 of a front holder 55 which constitutes a front surface of the mating connector 5, whereby the shorting contact pieces 86 of the shorting terminal 81 are deflected to the rear of the connector (to the right in FIG. 13B) to thereby release the shorting of the two male terminals 31A.

Namely, as a result of the abutment portions 87 which are provided at the front ends of the shorting contact pieces 86 being pushed to the rear of the connector, the portions of the shorting contact pieces 86 which extend forwards and obliquely upwards and is thereafter bent back into the U-like shape are elastically deformed to the rear, and the contact portions 88 which project towards the terminal box portions 35 are also displaced to the rear. Then, as shown in FIG. 14, a non-contact recess portion 38 is formed at the rear of a contact portion with the contact portion 88 on the top surface 37 of the terminal box portion 35 of the male terminal 31A. Then, the contact portion 88 is displaced to a position which corresponds to the non-contact recess portion 38 which is formed on the terminal box portion 35. Then, the contact portion 88 formed on the shorting contact piece 86 is disconnected from the terminal box portion 35, whereby the male terminals 31A are de-energized. Then, the shorting of the two male terminals 31A which lie adjacent to each other by the shorting terminal 81 is released.

When the fitting of the connector 1B and the mating connector 5 is released, the shorting contact pieces 86 of the shorting terminal 81 are elastically restored as a result of the pressing by the front wall 57 of the mating connector 5 being released, and the contact portions 88 of the shorting contact pieces 86 are brought into contact with the top surfaces 37 of the terminal box portions 35. As a result of this, the shorting terminal 81 is brought into contact with the two male terminals 31A to connect electrically the two male terminals 31A together while shorting them.

Thus, as has been described heretofore, according to the connector 1B of the third embodiment, on the shorting contact pieces 86 which are deflected to the rear of the connector, the contact portions 88 which project towards the terminal box portions 35 are displaced to the non-contact recess portions 38 which are formed on the terminal box portions 35, whereby the two male terminals 31A are electrically connected together and are released from the shorted state more smoothly and in an ensured fashion.

Fourth Embodiment

Figure 15:
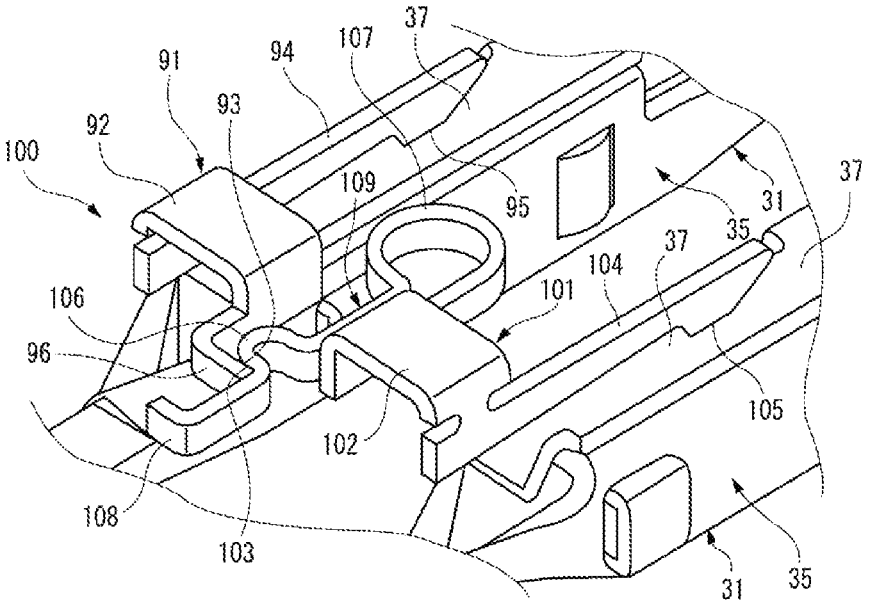
FIG. 15 is a perspective view of a shorting terminal for use in a connector according a fourth embodiment of the invention.
Figure 16:
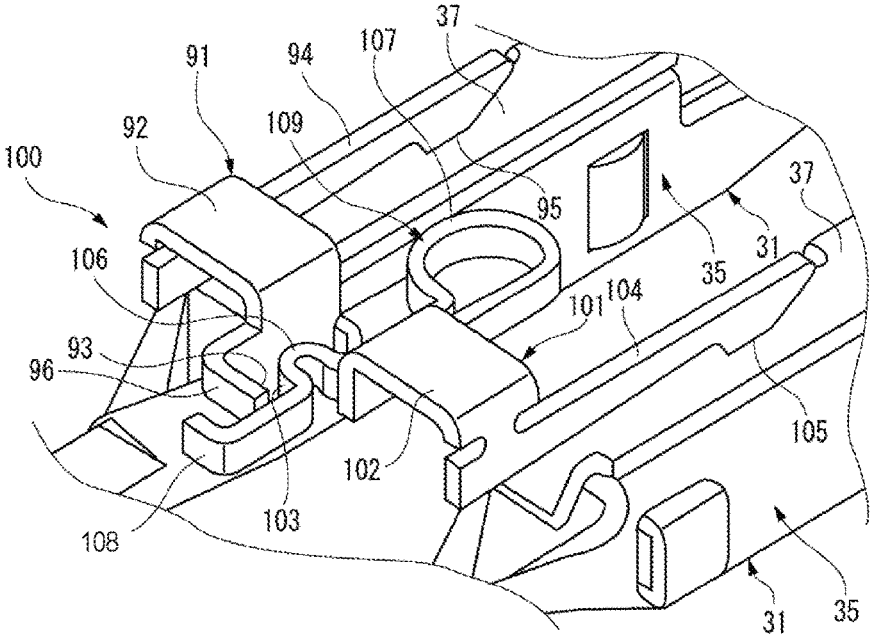
FIG. 16 is a perspective view showing a state in which the shorting terminal shown in FIG. 15 is released from a shorted state.

FIG. 15 is a perspective view of a shorting terminal 100 for use in a connector according to a fourth embodiment of the invention, and FIG. 16 is a perspective view of the shorting terminal 100 shown in FIG. 15 which is released from a shorted state with a connector housing and a front holder omitted from illustration.

As shown in FIGS. 15 and 16, the shorting terminal 100 has a first shorting terminal 101 which is electrically connected with one male terminal 31 (a right one in FIG. 15) and a second shorting terminal 91 which is electrically connected with the other male terminal 31 (a left one in FIG. 15).

The first shorting terminal 101 is a terminal which is formed by pressing a sheet of metal and includes a rectangular terminal main body 102 and a shorting contact piece 109 and a terminal contact piece 104 which are provided on opposite walls of the terminal main body 102 which are formed to be bent at both sides of the terminal main body 102.

The shorting contact piece 109 is formed into such a configuration that the shorting contact piece 109 extends to the rear from a rear end of the opposite wall on the other male terminal 31 of the terminal main body 102 and is then bent back to the front so as to extend substantially horizontally to project from a front surface 17 of a male housing main body portion 13 at a front end thereof. An abutment portion 108 is formed at a front end of the shorting contact piece 109 which projects from the front surface 17 of the male housing main body portion 13 by bending a front end portion of the shorting contact piece 109. Additionally, a curved portion 106 which makes up a contact portion 103 and an annular deforming portion 107 are formed at a portion of the shorting contact piece 109 which is situated at the rear of the abutment portion 108.

The terminal contact piece 104 is formed into such a configuration that the terminal contact piece 104 extends to the rear substantially horizontally from a rear end of the opposite wall of the male terminal 31 of the terminal main body portion 102 and a terminal contact portion 105 configured to be brought into contact with a top surface 37 of a terminal box portion 35 of the male terminal 31 is formed at a distal end of the terminal contact piece 104.

The second shorting terminal 91 is a terminal which is fabricated by pressing a sheet of metal and includes a shorting contact piece 96 and a terminal contact piece 94 which are provided on opposite walls of the terminal main body 92 which are formed to be bent at both sides of the terminal main body 92.

The shorting contact piece 96 extends to the front from a front end of the opposite wall of the terminal main body 92 which lies on a side thereof which faces the male terminal 31 and is thereafter bent towards the first shorting terminal 101, whereby a contact portion 93 is formed.

The terminal contact piece 94 extends to the rear substantially horizontally from a rear end of the opposite wall of the terminal main body 92 which lies opposite to the opposite wall on the side facing the male terminal 31, and a terminal contact portion 95 configured to be brought into contact with a top surface 37 of a terminal box portion 35 of the male terminal 31 is formed at a distal end of the terminal contact piece 94.

Then, a rear surface of the contact portion 93 of the second shorting terminal 91 is in abutment with a front surface of the contact portion 103 of the first shorting terminal 101, and the shorting contact piece 109 in which the contact portion 93 is restricted from moving to the front by the contact portion 103 is now accumulating momentum by an elastic repulsion force of the annular deforming portion 107.

Then, the shorting terminal 100 made up of the first shorting terminal 101 and the second shorting terminal 91 is installed in a front holder, not shown. When the front holder is fitted in the male housing main body portion 13, the shorting terminal 100 installed in the front holder is disposed adjacent to upper surface sides of the male terminals 31 (an upper side in FIG. 15), and the terminal contact portions 95, 105 are brought into contact with the top surfaces 37 of the terminal box portions 35 of the two male terminals 31. In this state, the contact portion 103 of the shorting contact piece 109 of the first shorting terminal 101 is in contact with the contact portion 93 of the second shorting terminal 91, and the abutment portion 108 at the front end of the shorting contact piece 109 project from the front surface 17 of the male housing main body portion 13. Consequently, the shorting terminal 100 connects electrically the two male terminals 31 together while shorting them.

Next, a fitting process of fitting a connector 1 including the shorting terminal 100 configured in the way described above into a mating connector 5 will be described.

When a female housing 51 is inserted into a male housing 11, the male terminals 31 of the male housing 11 are inserted into electric connecting portions 69 of female terminals 61 from terminal inserting openings 56 provided at a distal end side of the female housing 51, whereby the female terminals 61 and the male terminals 31 are electrically connected together.

As this occurs, the abutment portion 108 of the shorting contact piece 109 of the first shorting terminal 101 which projects from the front surface 17 of the male housing main body portion 13 which constitutes a front surface of the male housing 11 is pushed by a front wall 57 of a front holder 55 which constitutes a front surface of the mating connector 5, whereby the shorting contact piece 109 of the first shorting terminal 101 is deflected to the rear of the connector (to the right in FIG. 16), whereby the shorting of the two male terminals 31 is released.

Namely, as a result of the abutment portion 108 provided at the front end of the shorting contact piece 109 being pressed to the rear, the annular deforming portion 107 of the shorting contact piece 109 is elastically deformed to be displaced to the rear while the curved portion 106 which makes up the contact portion 103 moving towards the terminal main body 102. Then, the contact portion 103 formed on the shorting contact piece 109 moves away from the contact portion 93 of the second shorting terminal 91, whereby the male terminals 31 are de-energized. Then, the shorting of the two adjacent male terminals 31 by the shorting terminal 100 is released.

When the fitting of the connector 1 and the mating connector 5 is released, as a result of the pressing by the front wall 57 of the mating connector 5 being released, the shorting contact piece 109 of the first shorting terminal 101 is elastically restored, whereby the contact portion 103 of the shorting contact piece 109 is brought into contact with the contact portion 93 of the second shorting terminal 91. As a result of this, the shorting terminal 100 is brought into contact with the two male terminals 31 again to connect electrically the two male terminals 31 together while shorting them.

Thus, as has been described heretofore, according to the connector 1 using the shorting terminal 100 according to the fourth embodiment, when the connector 1 is fitted together with the mating connector 5, the abutment portion 108 of the shorting contact piece 109 of the first shorting terminal 101 which project from the front surface 17 of the male housing main body portion 13 is pressed against by the front wall 57 of the front holder 55 which constitutes the front surface of the mating connector 5, whereby the contact portion 103 of the first shorting terminal 101 is displaced to the position where the contact portion 103 lies away from the contact portion 93 of the second shorting terminal 91, and the shoring of the two male terminals 31 is released.

Then, the shorting terminal 100 configured in the way described above can cause the contact portion 103 of the first shorting terminal 101 and the contact portion 93 of the second shorting terminal 91 to move away from each other according to a fitting stroke of the connector 1 into the mating connector 5. Namely, since the annular deforming portion 107 of the shorting contact piece 109 has a sufficient elastically deforming amount, it becomes easy to take a great separation space between the contact portion 103 and the contact portion 93 according to the fitting stroke by expanding a space between the curved portion 106 which makes up the contact portion 103 and the abutment portion 108 as required. Consequently, in the connector configured in the way described above, the shorting of the two male terminals 31 can be released in a more ensured fashion, providing a high degree of freedom in designing the construction.

Thus, according to the connectors 1, 1A, 1B of the embodiments described above, the production costs can be reduced by preventing molds for the male housing 11 and the female housing 51 from becoming complex in configuration, and the shorting of the pair of male terminals 31 can be released well without calling for an enlargement in size of the connector.

The invention is not limited to the embodiments that have been described heretofore and hence can be modified or improved as required. In addition, the materials, shapes or configurations, dimensions, numbers and locations of the constituent elements described in the embodiments are arbitrary and are not limited to those described as long as they can achieve the invention.

For example, in the embodiments, the male terminals 31 are described as being used as the terminal fittings and the male housing 11 is described as being used as the connector housing. However, the terminal fittings of the invention may be used as the female terminals, and the connector housing may be used as the female housing. Additionally, the shorting terminals 41 71, 81, 100 of the embodiments are described as being installed in the front holder 21 to thereby be disposed in the connector housing. However, needless to say, the shorting terminals 41, 71, 81, 100 may directly be installed in the connector housing.

Here, the characteristics of the embodiments of the connector according to the invention will be summarized briefly item by item under [1] to [5] below.

[1] A connector (1, 1A, 1B) comprising:

at least two terminal fittings (male terminals 31, 31A);

a connector housing (a male housing 11) including terminal accommodating chambers (15) which respectively accommodate the at least two terminal fittings; and a shorting terminal (41, 71, 81, 100) electrically connecting the at least two terminal fittings to each other, wherein an electrical connection of the at least two terminal fittings is released by a mating connector (5) which is fitted on the connector, wherein abutment portions (47, 77, 87, 108) provided at front ends of shorting contact pieces (46, 76, 86, 109) of the shorting terminal project from a front surface of the connector housing (a front surface 17 of a male housing main body portion 13), and wherein a front surface of the mating connector (a front wall 57 of a front holder 55) facing a front surface of the connector housing presses against the abutment portions and deflects the shorting contact pieces in a rear direction of the connector so as to release shorting of the at least two terminal fittings.

[2] The connector according to the above-described [1], wherein the shorting contact pieces (46) are deflected in the rear direction of the connector by the front surface of the mating connector (the front wall 57 of the front holder 55) and respectively brought into contact with projecting portions, the shorting contact pieces are displaced to positions in which the shorting contact pieces (46) separate from the at least two terminal fittings (the male terminals 31) so as to release contact of the shorting contact pieces with the at least two terminal fittings, and wherein the projecting portions are formed on the terminal accommodating chambers and capable of abutting to the shorting contact pieces.

[3] The connector (1A) according to the above-described [1], wherein the shorting contact pieces (76) include contact portions (78) which project towards terminal box portions (35) of the at least two terminal fittings (31) and which are brought into contact with the terminal box portions respectively, and wherein the shorting contact pieces (76) are deflected in the rear direction of the connector by the front surface of the mating connector (the front wall 57 of the front holder 55) and the contact portions are displace to positions in which the contact portions separate from the terminal box portions so as to release the contact of the shorting contact pieces with the terminal box portions.

[4] The connector (1B) according to the above-described [1], wherein the shorting contact pieces (86) include contact portions (88) which project towards terminal box portions (35) of the at least two terminal fittings (31A) and which are brought into contact with the terminal box portions respectively, and wherein the shorting contact pieces (86) are deflected in the rear direction of the connector by the front surface of the mating connector (5) (the front wall 57 of the front holder 55) and the contact portions are displace to non-contact recess portions (38) formed on the terminal box portions so as to release the contact of the shorting contact pieces with the terminal box portions.

[5] The connector (1) according to the above-described [1], wherein the shorting terminal (100) includes a first shorting terminal (101) and a second shorting terminal (91), wherein the first shorting terminal (101) is electrically connected with one of at lease the two terminal fittings (31), wherein the second shorting terminal (91) is electrically connected with another of the at least two terminal fittings (31), wherein a contact portion (103) of the first shorting terminal and a contact portion (93) of the second shorting terminal are brought into contact with each other so that the first shorting terminal (101) and the second shorting terminal (91) are electrically connected each other, wherein an abutment portion (108) provided at a front end of the shorting contact piece (109) of the first shorting terminal projects from the front surface of the connector housing (the front surface 17 of the male housing main body portion 13), and wherein the front surface of the mating connector (the front wall 57 of the front holder 55) facing the front surface of the connector housing presses against the abutment portion and the shorting contact piece is deflect in the rear direction of the connector and the contact portion of the first shorting terminal is displaced to a position in which the contact portion of the first shorting terminal separates away from the contact portion of the second shorting terminal so as to release the shorting of the two terminal fittings.

DESCRIPTION OF REFERENCE NUMERALS

1: connector; 5: mating connector; 11: male housing (connector housing); 13: male housing main body portion; 15: terminal accommodating chamber; 17: front surface (front surface of connector housing); 31: male terminal (metallic terminal part); 41: shorting terminal; 46: shorting contact piece; 47: abutment portion; 57: front wall (front surface of mating connector).

What is claimed is:

1. A connector comprising:

at least two terminal fittings;

a connector housing including terminal accommodating chambers which respectively accommodate the at least two terminal fittings; and a shorting terminal electrically connecting the at least two terminal fittings to each other, wherein an electrical connection of the at least two terminal fittings is released by a mating connector which is fitted on the connector, wherein abutment portions provided at front ends of shorting contact pieces of the shorting terminal project from a front surface of the connector housing, and wherein a front surface of the mating connector facing a front surface of the connector housing presses against the abutment portions and deflects the shorting contact pieces in a rear direction of the connector so as to release shorting of the at least two terminal fittings.

2. The connector according to claim 1, wherein the shorting contact pieces are deflected in the rear direction of the connector by the front surface of the mating connector and respectively brought into contact with projecting portions, the shorting contact pieces are displaced to positions in which the shorting contact pieces separate from the at least two terminal fittings so as to release contact of the shorting contact pieces with the at least two terminal fittings, and wherein the projecting portions are formed on the terminal accommodating chambers and capable of abutting to the shorting contact pieces.

3. The connector according to claim 1, wherein the shorting contact pieces include contact portions which project towards terminal box portions of the at least two terminal fittings and which are brought into contact with the terminal box portions respectively, and wherein the shorting contact pieces are deflected in the rear direction of the connector by the front surface of the mating connector and the contact portions are displaced to positions in which the contact portions separate from the terminal box portions so as to release the contact of the shorting contact pieces with the terminal box portions.

4. The connector according to claim 1, wherein the shorting contact pieces include contact portions which project towards terminal box portions of the at least two terminal fittings and which are brought into contact with the terminal box portions respectively, and wherein the shorting contact pieces are deflected in the rear direction of the connector by the front surface of the mating connector and the contact portions are displaced to non-contact recess portions formed on the terminal box portions so as to release the contact of the shorting contact pieces with the terminal box portions.

5. The connector according to claim 1, wherein the shorting terminal includes a first shorting terminal and a second shorting terminal, wherein the first shorting terminal is electrically connected with one of the at least two terminal fittings, wherein the second shorting terminal is electrically connected with another of the at least two terminal fittings, wherein a contact portion of the first shorting terminal and a contact portion of the second shorting terminal are brought into contact with each other so that the first shorting terminal and the second shorting terminal are electrically connected to each other, wherein an abutment portion provided at a front end of a shorting contact piece of the first shorting terminal projects from the front surface of the connector housing, and wherein the front surface of the mating connector facing the front surface of the connector housing presses against the abutment portion and the shorting contact piece is deflected in the rear direction of the connector and the contact portion of the first shorting terminal is displaced to a position in which the contact portion of the first shorting terminal separates away from the contact portion of the second shorting terminal so as to release the shorting of the at least two terminal fittings.

* * * * *